US008249290B2

(12) United States Patent
Funahashi

(10) Patent No.: US 8,249,290 B2
(45) Date of Patent: Aug. 21, 2012

(54) SPEAKER

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 1422 days.

(21) Appl. No.: 11/658,913

(22) PCT Filed: Sep. 20, 2006

(86) PCT No.: PCT/JP2006/318562
§ 371 (c)(1),
(2), (4) Date: Jan. 30, 2007

(87) PCT Pub. No.: WO2007/037153
PCT Pub. Date: Apr. 5, 2007

(65) Prior Publication Data

US 2009/0232344 A1 Sep. 17, 2009

(30) Foreign Application Priority Data

Sep. 28, 2005 (JP) ..... 2005-281764

(51) Int. Cl.
*H04R 1/00* (2006.01)

(52) U.S. Cl. ..... 381/398; 381/403; 381/404

(58) Field of Classification Search ..... 381/398, 381/433, 403–404
See application file for complete search history.

(56) References Cited

U.S. PATENT DOCUMENTS

| | | | | |
|---|---|---|---|---|
| 4,565,905 | A * | 1/1986 | Nation | 381/186 |
| 5,847,333 | A * | 12/1998 | D'Hoogh | 181/171 |
| 6,993,146 | B2 * | 1/2006 | Sato | 381/398 |
| 7,209,570 | B2 | 4/2007 | Funahashi et al. | |
| 7,292,707 | B2 * | 11/2007 | Kreitmeier et al. | 381/398 |
| 7,324,569 | B2 * | 1/2008 | Flanders et al. | 372/20 |
| 7,542,583 | B2 | 6/2009 | Funahashi | |
| 7,570,774 | B2 * | 8/2009 | Jeong et al. | 381/186 |
| 8,045,745 | B2 * | 10/2011 | Horigome et al. | 381/398 |
| 2003/0185415 | A1 * | 10/2003 | Funahashi et al. | 381/398 |
| 2005/0141746 | A1 * | 6/2005 | Kobayashi et al. | 381/424 |
| 2005/0201588 | A1 | 9/2005 | Funahashi et al. | |

FOREIGN PATENT DOCUMENTS

| | | |
|---|---|---|
| EP | 1 515 583 | 3/2005 |
| JP | 45-33465 | 10/1970 |
| JP | 51-32097 | 9/1976 |
| JP | 2004-007332 | 1/2004 |
| JP | 2004-7332 | 1/2004 |
| JP | 2005-252924 | 9/2005 |
| KR | 2005-0030172 | 3/2005 |

OTHER PUBLICATIONS

Supplemental European Search Report, issued Dec. 16, 2010 in EP Application 06 79 8122, which is a counterpart to the present application.

* cited by examiner

*Primary Examiner* — Curtis Kuntz
*Assistant Examiner* — Ryan Robinson
(74) *Attorney, Agent, or Firm* — Wenderoth, Lind & Ponack, LLP.

(57) ABSTRACT

The frame of a speaker is divided into a first frame part and a second frame part. The outer circumferential edge of the suspension holder is sandwiched between the surfaces of the first and second frame parts. This structure can reduce rolling of the diaphragm and harmonic distortion of the speaker.

18 Claims, 2 Drawing Sheets

FIG. 4 – PRIOR ART

SPEAKER

This application is a U.S. national phase application of PCT International Application PCT/JP2006/318562, filed Sep. 20, 2006.

TECHNICAL FIELD

The present invention relates to the structure of a speaker.

BACKGROUND ART

FIG. 4 is a section of a conventional speaker. Voice coil 22 is disposed in the gap of magnetic circuit 21. The inner circumferential edge of diaphragm 23 is connected to voice coil 22. The outer circumferential edge of diaphragm 23 is coupled to frame 25 via edge 24. The backside of diaphragm 23 is coupled to frame 25 via suspension holder 26 and edge 27. The symmetrical structure of edges 24 and 27 allows diaphragm 23 to vibrate as symmetrically as possible in the vertical direction, thus reducing distortion of the speaker. This conventional art is disclosed in Japanese Patent Unexamined Publication No. 2004-7332, for example.

However, in the conventional speaker, ring-shaped edge 27 has diameter a smaller than diameter b of ring-shaped edge 24; thus, the speaker cannot eliminate harmonic distortion sufficiently.

SUMMARY OF THE INVENTION

A speaker of the present invention includes: a frame; a magnetic circuit disposed in the frame; a voice coil disposed movably with respect to a magnetic gap in the magnetic circuit; a diaphragm having an inner circumferential edge connected to the voice coil, and an outer circumferential edge coupled to the frame via a first edge; and a suspension holder connected to the backside of the diaphragm and having an outer circumferential edge coupled to the frame via a second edge. The frame has a block construction including a first frame part and a second frame part. The outer circumferential edge of the second edge is sandwiched between the first and second frame parts. This structure largely eliminates harmonic distortion of the speaker.

BRIEF DESCRIPTION OF THE DRAWINGS

FIG. 4 is a part of a section of a conventional speaker.

DETAILED DESCRIPTION OF PREFERRED EMBODIMENTS

Figure 1:
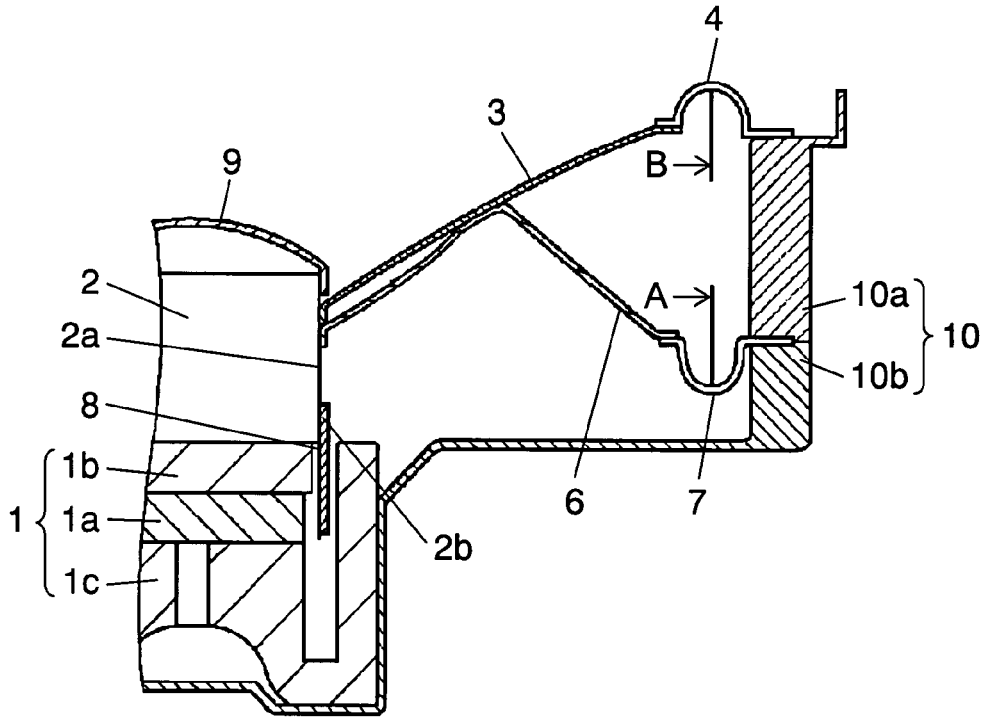
FIG. 1 is a part of a section of a speaker in accordance with an exemplary embodiment of the present invention.

Hereinafter, a description is provided of exemplary embodiments of the present invention, with reference to the accompanying drawings. FIG. 1 is a section of a speaker in accordance with an exemplary embodiment of the present invention.

Magnetic circuit 1 is disposed in the center of the bottom of frame 10. Magnetic circuit 1 includes disk-shaped magnet 1*a*, disk-shaped plate 1*b*, cup-shaped yoke 1*c*, and magnetic gap 8 formed between plate 1*b* and the sidewall of yoke 1*c*.

Voice coil 2 includes cylindrical bobbin 2*a*, coil 2*b* wound around cylindrical bobbin 2*a*, and dust cap 9. Coil 2*b* is inserted into magnetic gap 8. Voice coil 2 is disposed vertically movable with respect to magnetic gap 8 to vibrate diaphragm 3, i.e. the sound source of the speaker, connected along the outer circumference of bobbin 2*a*. The outer circumferential edge of diaphragm 3 is coupled to the open end of frame 10 via first edge 4. The inner circumferential edge of diaphragm 3 is connected to voice coil 2. First edge 4 is made of a material capable of preventing a dynamic load from being imposed on diaphragm 3, such as urethane, expanded rubber, styrene-butadiene rubber (SBR), or cloth.

The outer circumferential edge of suspension holder 6 is coupled to frame 10 via second edge 7. The middle portion of suspension holder 6 is integrated with the backside of the middle portion of diaphragm 3 by bonding. Then, the inner circumferential edge of suspension holder 6 is fixed to voice coil 2 together with the inner circumferential edge of diaphragm 3.

Suspension holder 6 is a mass added to diaphragm 3 and thus decreases efficiency of the speaker. For this reason, preferably, the suspension holder is as light as possible, and made of pulp or resin. Second edge 7 is made of a material capable of preventing a dynamic load from being imposed on diaphragm 3 and suspension holder 6, such as urethane, expanded rubber, SBR rubber, or cloth.

Placing the junction point of voice coil 2 and diaphragm 3, and the junction point of voice coil 2 and suspension holder 6, i.e. the driving points, within the area surrounded by first edge 4 and second edge 7, i.e. both fulcrums connected to frame 10, can provide a structure capable of inhibiting rolling of diaphragm 3 and harmonic distortion.

First edge 4 and second edge 7 are both ring-shaped. First edge 4 projects upward, and second edge 7 projects downward. Thus, both edges have symmetrical shapes or symmetrical amplitude characteristics with respect to each other.

Figure 2:
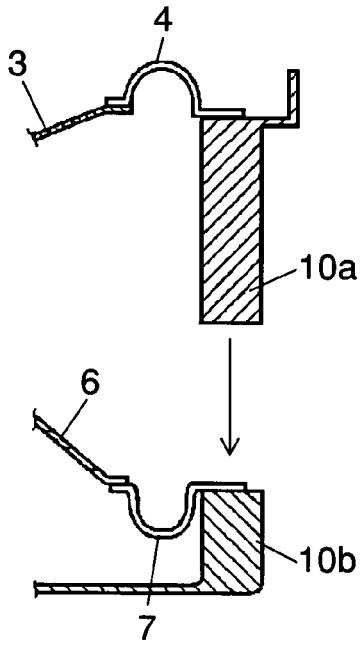
FIG. 2 is a section of a frame of the speaker shown in FIG. 1.

As shown in FIG. 2, cylindrical frame 10 is divided into upper frame 10*a* (first frame part) and lower frame 10*b* (second frame part). First edge 4 is connected to upper frame 10*a*, and second edge 7 is connected between frame 10*a* and frame 10*b*. That is, as illustrated, the cylindrical frame parts 10*a*, 10*b* (having cylindrical inner and outer peripheral surfaces) are aligned with each other to form an overall cylindrical frame 10. This structure can largely inhibit harmonic distortion of the speaker.

In other words, dividing frame 10 into upper frame 10*a* and lower frame 10*b* makes diameter B of ring-shaped edge 4 and diameter A of ring-shaped edge 7 equal to each other and ensures symmetry of edges 4 and 7. This structure can improve amplitude symmetry, and further reduce harmonic distortion of the speaker.

Figure 3:
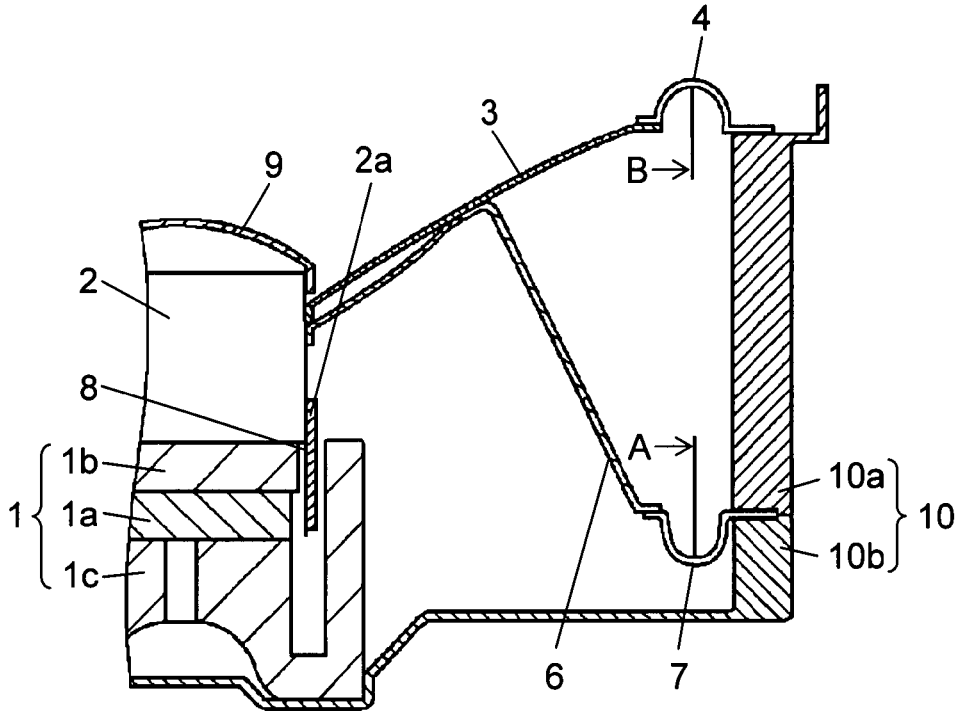
FIG. 3 is a part of a section of a speaker in accordance with another exemplary embodiment of the present invention.
Figure 3:
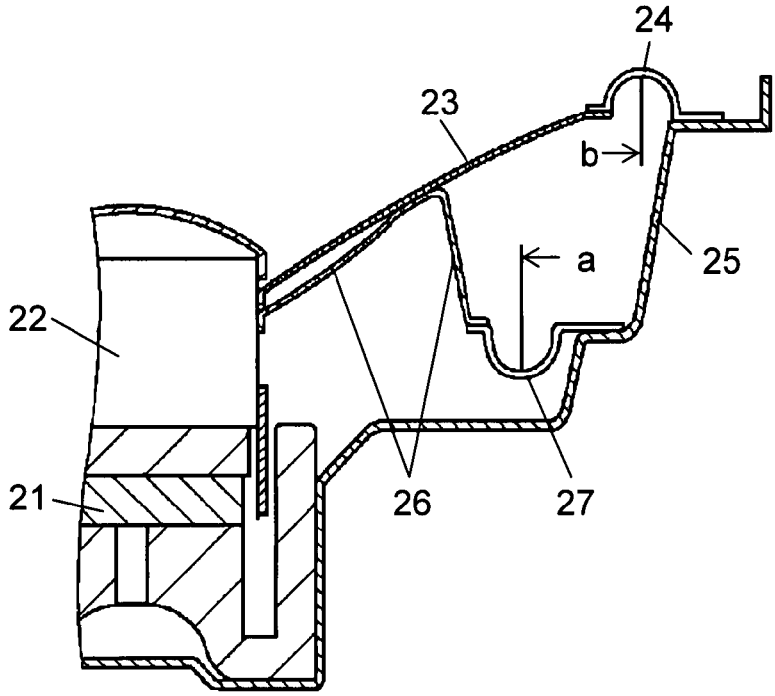

Further, as shown in FIG. 3, the position in which frames 10*a* and 10*b* sandwich second edge 7 can be set below the upper end of magnetic circuit 1. This setting allows magnetic gap 8 for generating driving force of voice coil 2, the junction point of diaphragm 3 and voice coil 2, and the junction point of suspension holder 6 and voice coil 2, i.e. the driving points, to be disposed within the area surrounded by first edge 4 and second edge 7 both forming fulcrums. This structure can reduce rolling of diaphragm 3 and harmonic distortion of the speaker more efficiently.

The present invention inhibits distortion of a speaker, and thus is particularly useful to high-power speakers.

The invention claimed is:

1. A speaker comprising:

a frame;

a magnetic circuit disposed in the frame and having a magnetic gap;

a voice coil disposed movably with respect to the magnetic gap in the magnetic circuit;

a diaphragm having an inner circumferential edge coupled to the voice coil, and an outer circumferential edge coupled to the frame via a first edge; and a suspension holder coupled to a backside of the diaphragm and having an outer circumferential edge coupled to the frame via a second edge;

wherein the frame has a block construction including a first frame part and a second frame part, and an outer circumferential edge of the second edge is sandwiched between the first and second frame parts; and wherein the first edge has a shape symmetrical to a shape of the second edge; and wherein the first edge has a ring shape surrounding the diaphragm and the second edge has a ring shape surrounding the suspension holder, and a diameter of the ring shape of the first edge and a diameter of the ring shape of the second edge are equal to each other.

2. The speaker of claim 1, wherein the frame is divided in a position set below an upper end of the magnetic circuit.

3. The speaker of claim 1, wherein the first and second edges have amplitude characteristics symmetrical to each other.

4. The speaker of claim 2, wherein the first and second edges have amplitude characteristics symmetrical to each other.

5. The speaker of claim 1, wherein the first edge and the second edge project in directions opposite to each other.

6. The speaker of claim 5, wherein the first edge and the second edge project away from each other.

7. The speaker of claim 2, wherein the first edge and the second edge project in directions opposite to each other.

8. The speaker of claim 7, wherein the first edge and the second edge project away from each other.

9. The speaker of claim 1, wherein the first edge and the second edge project in directions away from each other.

10. The speaker of claim 2, wherein the first edge and the second edge project in directions away from each other.

11. The speaker of claim 1, wherein the suspension holder is coupled to the backside of the diaphragm at a location spaced outwardly away from the voice coil.

12. The speaker of claim 2, wherein the suspension holder is coupled to the backside of the diaphragm at a location spaced outwardly away from the voice coil.

13. The speaker of claim 5, wherein the suspension holder is coupled to the backside of the diaphragm at a location spaced outwardly away from the voice coil.

14. The speaker of claim 7, wherein the suspension holder is coupled to the backside of the diaphragm at a location spaced outwardly away from the voice coil.

15. The speaker of claim 9, wherein the suspension holder is coupled to the backside of the diaphragm at a location spaced outwardly away from the voice coil.

16. The speaker of claim 1, wherein the diameter of the first edge is defined between diametrically opposite points on a first ridge at an apex of the first edge outside of the diaphragm; and the diameter of the second edge is defined between diametrically opposite points on a second ridge at an apex of the second edge outside of the suspension holder.

17. The speaker of claim 1, wherein the first ridge of the first edge and the second ridge of the second edge are, coincident with each other when viewed along an axial direction of the ring shapes of the first and second edges.

18. The speaker of claim 1, wherein the first frame part and the second frame part respectively have cylindrical inner peripheral surfaces that are aligned with each other such that the frame has an overall cylindrical inner peripheral surface, thereby allowing the first and second edges to have the ring shapes thereof of equal diameters.

* * * * *